US005129003A

United States Patent [19]

Saruta

[11] Patent Number: 5,129,003

[45] Date of Patent: Jul. 7, 1992

[54] ACTIVE NOISE CONTROL APPARATUS FOR DOMESTIC APPLIANCE

[75] Inventor: Susumu Saruta, Ebina, Japan

[73] Assignee: Kabushiki Kaisha Toshiba, Kawasaki, Japan

[21] Appl. No.: 571,409

[22] Filed: Aug. 23, 1990

[30] Foreign Application Priority Data

Aug. 31, 1989 [JP] Japan ..... 1-225431

[51] Int. Cl.[5] ..... G10K 11/16

[52] U.S. Cl. ..... 381/71

[58] Field of Search ..... 381/71, 94

[56] References Cited

U.S. PATENT DOCUMENTS 4,417,098 11/1983 Chaplin et al. ..... 381/94

4,989,252 1/1991 Nakanishi et al. ..... 381/71

FOREIGN PATENT DOCUMENTS 8603354 6/1986 World Int. Prop. O. ..... 381/94

8802912 4/1988 World Int. Prop. O. .

OTHER PUBLICATIONS

IEICE (Institute of Electronics, Information and Communication Engineers of Japan) Technical Report vol. 88 No. 105; Jun. 30, 1988.

Motorola Semiconductor Technical Data DSP56200 pp. 1-5.

*Primary Examiner*—Forester W. Isen

*Attorney, Agent, or Firm*—Cushman, Darby & Cushman

[57] ABSTRACT

An apparatus includes an electro-acoustic converter, a detector, a noise correlative signal generator, and an additional tone signal generator in order to actively control noise generated by an electromagnetic machine, which noise is apt to externally leak from an opening of a machine room storing the electromagnetic machine driven by an AC power supply. The electro-acoustic converter applies a predetermined sound wave to the opening of the machine room. The detector essentially detects a frequency of an AC voltage waveform to be applied to the electromagnetic machine driven by the AC power supply. The noise correlative signal generator generates generating a signal correlative with an electromagnetic noise component included in noise generated by the electromagnetic machine according to a detection signal from the detector. The additional tone signal generator generates, according to an output signal from the noise correlative signal generator, an additional tone signal for causing the electro-acoustic converter to apply a sound wave essentially having a phase opposite to and the same amplitude as those of the electromagnetic noise component at the opening of the machine room.

13 Claims, 7 Drawing Sheets

ACTIVE NOISE CONTROL APPARATUS FOR DOMESTIC APPLIANCE

BACKGROUND OF THE INVENTION

1. Field of the Invention

The present invention relates to an active noise control apparatus for a domestic appliance and, more particularly, to a noise canceler which can actively cancel noise which is apt to externally leak from an opening portion of a machine room storing a rotary machine which serves as a driving source for a domestic appliance and is driven by an AC power supply.

2. Description of the Related Art

Recently, various electric appliances have been used at home. These appliances pose a problem in terms of noise in living rooms For example, compressors which generate noise are integrally assembled in most of domestic electrical refrigerators. Such electrical refrigerators tend to be equipped near the living rooms. For this reason, it is important to eliminate noise leaking from the electrical refrigerator into the living rooms.

In an electrical refrigerator, most of noise components are generated by a compressor and a piping system connected thereto. More specifically, the compressor generates operation noise of a motor, fluid noise caused by a compressed gas, mechanical noise of a compression mechanism portion, and the like. The piping system connected to the compressor vibrates upon reception of the vibration of the compressor, thus generating noise.

For these reasons, an electrical refrigerator employs a so-called machine room storing a compressor as a noise source and a piping system connected thereto, so that the machine room eliminates noise leakage. In addition, the electrical refrigerator employs a rotary compressor which generates relatively low noise, an anti-vibration support mechanism of the compressor is improved, or the shape of the piping system is improved to attenuate vibration in a vibration transmission path. Alternatively, a sound insulating member or a sound shielding member is arranged around the compressor and the piping system to increase a sound insulation amount or to increase a noise transmission loss.

A heat radiation opening for radiating heat generated upon operation of the compressor must be formed in the wall of the machine room. For this reason, noise leaks from this opening. Even when the above-mentioned countermeasures for eliminating noise are taken, a noise level can only be reduced by at most 2 dB (ISO-A characteristics).

Recently, upon application of an acoustic control technique, a tone having an opposite phase to and the same wavelength and amplitude as those of a noise component is artificially generated to actively cancel noise leaking from the opening of the machine room, thereby eliminating noise of an electrical refrigerator. In the active noise control, a noise component from a noise source i converted into an electrical signal by a control tone receiver (e.g., a microphone) arranged at a specific position, and a control tone generator (e.g., a loudspeaker) is operated on the basis of a signal obtained by processing the converted electrical signal by a computer, thereby generating an artificial tone having an opposite phase to and the same wavelength and amplitude as those of a noise component, so that the artificial tone and the noise component as an original tone are interfered with each other, thereby attenuating the original tone.

The active noise control is described in a reference entitled "IEICE (Institute of Electronics, Information and Communication Engineers of Japan) Technical Report Vol. 88, No. 105; Jun. 30, 1988", and will be explained below with reference to FIG. 9.

In FIG. 9, a tone generated by a compressor S as a noise source is represented by $X_s$, a tone generated by a loudspeaker A as a control tone generator is represented by $X_a$, a tone received by a microphone M as a control tone receiver is represented by $X_m$, a tone at a noise cancel objective point O is represented by $X_o$, and acoustic transfer functions among these tones are respectively represented by $G_{AM}$, $G_{AO}$, $G_{SM}$, and $G_{SO}$, the following equation is established in a two-input, two-output system. The acoustic transfer functions $G_{AM}$, $G_{AO}$, $G_{SM}$, and $G_{SO}$ imply that the former suffixes correspond to the transmission sides, and the latter suffixes correspond to the response sides For example, $G_{AM}$ represents an acoustic transfer function when an input signal to the loudspeaker A corresponds to an input side and an output signal from the microphone M corresponds to an output side to perform measurement.

$$\begin{pmatrix} X_m \\ X_o \end{pmatrix} = \begin{pmatrix} G_{SM} & G_{AM} \\ G_{SO} & G_{AO} \end{pmatrix} \begin{pmatrix} X_s \\ X_a \end{pmatrix}$$

From the above equation, a tone $X_a$ to be generated by the loudspeaker A is given by:

$$X_a = (-G_{SO} \cdot X_m + G_{SM} \cdot X_o)/(G_{SM} \cdot GA_O - G_{SO} \cdot G_{AM})$$

In this case, since it is aimed at making an acoustic level at the noise cancel objective point O zero, $X_o = 0$ can be set. As a result, we have:

$$X_1 = X_m \cdot G_{SO}/(G_{SO} \cdot G_{AM} \cdot G_{SM} \cdot G_{AO})$$

As can be seen from the above equation, in order to make the tone $X_o$ zero at the noise cancel objective point O, a tone $X_a$ obtained by filtering the tone $X_m$ received by the microphone M using a coefficient according to a transfer function G expressed by the following equation need only be generated to theoretically make the acoustic level zero at the control objective point O:

$$G = G_{SO}/(G_{SO} \cdot G_{AM} - G_{SM} \cdot G_{AO})$$

For this purpose, a computer H is arranged.

However, when the active noise control method is employed to reduce noise components of a electrical refrigerator, the following problem remains unsolved. More specifically, in the active noise control method, noise of the compressor S is detected by the microphone M, signal processing is performed on the basis of the detection signal, and an additional tone for canceling noise is generated by the loudspeaker A on the basis of the signal obtained by the signal processing. However, when the microphone M detects noise generated by anything other than the compressor, i.e., noise generated outside the machine room, noise control cannot be performed, and extra noise is undesirably generated by a noise control system.

In order to solve such a drawback, a vibration pickup is attached in place of the microphone to detect a vibration of the compressor, thereby generating an additional tone necessary for noise control. However, with this method, in the electrical refrigerator, when a vibration caused when a door of a vegetable compartment is opened/closed is transmitted to the compressor, and is detected by the vibration pickup, extra noise is also undesirably generated by a noise control system.

The same applies to other domestic appliances other than the electrical refrigerator (e.g., an electric washing machine, a drying machine, a dish washer, air conditioner, and the like).

As described above, even when noise components that are apt to externally leak from an opening portion of a machine room storing a rotary machine driven by an AC power supply are to be actively controlled like in a machine room of a domestic appliance, e g., a refrigerator by the conventional active noise control method, a noise control system undesirably generates extra noise depending on an environmental condition.

SUMMARY OF THE INVENTION

It is, therefore, an object of the present invention to provide a new and improved active noise control apparatus for a domestic appliance in which noise components that are apt to externally leak from an opening portion of a machine room can be controlled in response to only noise generated by a rotary machine regardless of external noise or an externally applied vibration.

According to one aspect of the present invention, there is provided an apparatus for actively controlling noise generated by an electromagnetic machine, which noise is apt to externally leak from an opening of a machine room storing the electromagnetic machine driven by an AC power supply, the apparatus comprising:

electro-acoustic conversion means for applying a predetermined sound wave to the opening of the machine room;

detection means for essentially detecting a frequency of an AC voltage waveform to be applied to the electromagnetic machine driven by the AC power supply;

noise correlative signal generating means for generating a signal correlative with an electromagnetic noise component included in noise generated by the electromagnetic machine according to a detection signal from the detection means; and additional tone signal generating means for generating, according to an output signal from the noise correlative signal generating means, an additional tone signal for causing the electro-acoustic conversion means to apply a sound wave essentially having a phase opposite to and the same amplitude as those of the electromagnetic noise component at the opening of the machine room.

In order to achieve the above object, in an active noise control apparatus for a domestic appliance according to the present invention, a drive input waveform of a rotary machine is detected, an additional tone signal necessary for noise control is formed on the basis of the detection output, and an electro-acoustic converter is driven by the additional tone signal, thereby controlling externally leaking noise components.

For example, when beat noise leaking from an opening of a machine room is to be canceled, the apparatus of the present invention comprises a detection unit for detecting a driving voltage waveform or frequency of a rotary machine, a generation unit for generating a signal having a correlation with an electromagnetic tone component of the rotary machine upon reception of a detection signal obtained by the detection unit, and a driving unit for generating an additional tone signal for canceling the electromagnetic tone component at the opening on the basis of the signal generated by the generation unit, and driving an electro-acoustic converter arranged in a machine room.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention, in which.

DETAILED DESCRIPTION OF THE PREFERRED EMBODIMENTS

Figure 1:
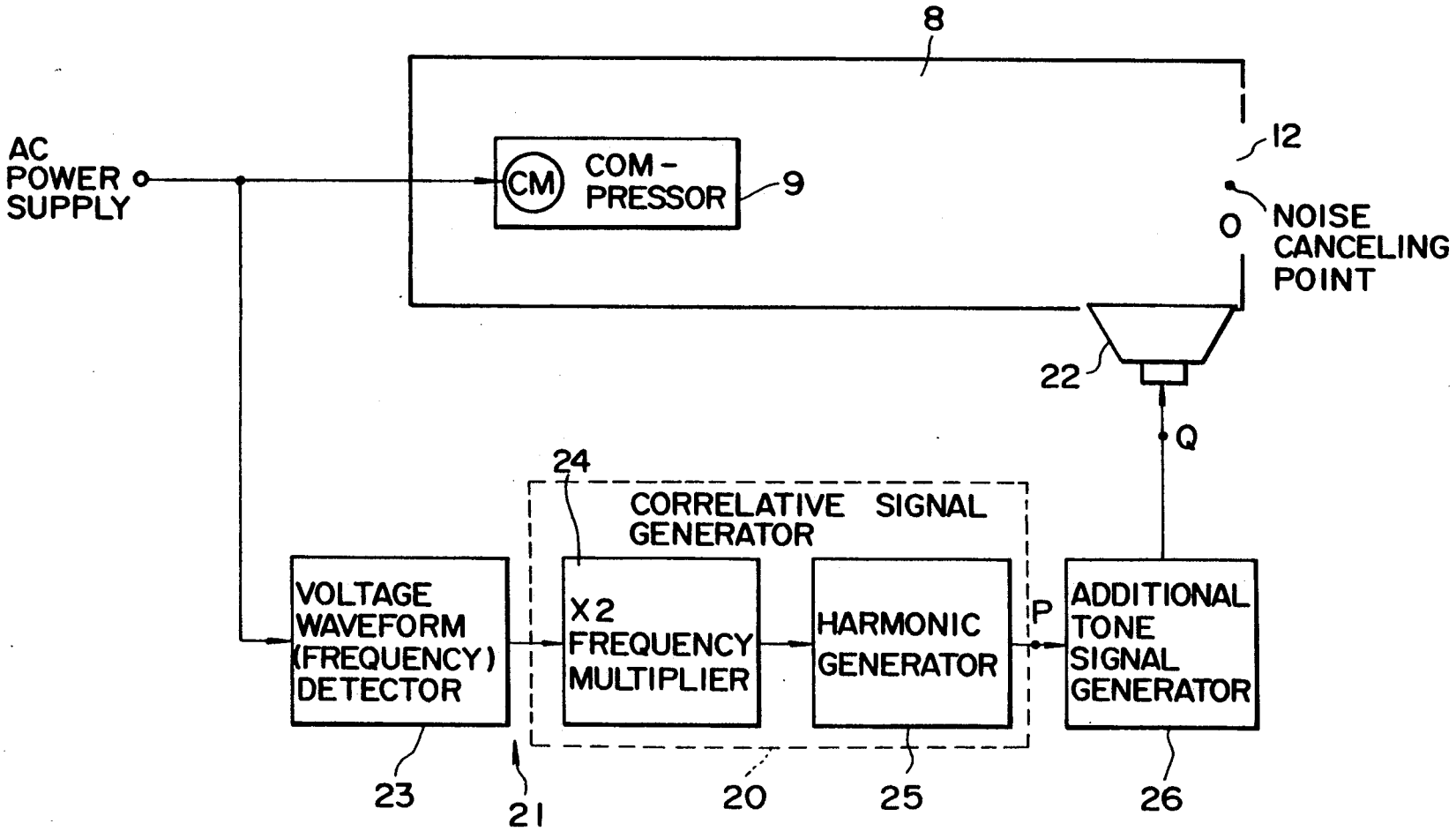
FIG. 1 is a block diagram of an active noise control apparatus for a domestic appliance according to an embodiment of the present invention.

Reference will be made in detail to the presently preferred embodiments of the invention as illustrated in the accompanying drawings, in which like reference characters designate like or corresponding parts throughout the several drawings.

The principle of the present invention will be described below.

A rotary machine serving as a driving source for a domestic appliance, e.g., a compressor housed in a machine room of a refrigerator will be exemplified below. Noise spectra generated by a driving operation of a compressor show a distribution as indicated by a solid curve in FIG. 8. That is, the major components of these spectra are a component corresponding to an integer multiple of a frequency $f_1$ of the compressor, a component corresponding to an even-numbered multiple of a power supply frequency $f_2$, and a component obtained by amplitude-modulating the even-numbered multiple component of the power supply frequency $f_2$ with the frequency fl of the compressor. The frequencies of the spectra can be expressed by:

$nf_1$ . . . rotational noise $2nf_1$ . . . electromagnetic noise $2nf_2 \pm f_1$ . . . modulated noise Therefore, as for a compressor having a power supply frequency of 50 Hz and a rotational frequency of 49 Hz, major spectrum frequencies are 49 Hz, 51 Hz, 98 Hz, 100 Hz, 147 Hz, 149 Hz, 151 Hz, 196 Hz, 200 Hz, 245 Hz, 249 Hz, 251 Hz, . . .

Since the compressor is a rotary machine, a rotational cycle signal has correlation with rotational noise. More specifically since rotational angles of a compressor mechanism portion have one-to-one correspondences with intake, compression, and exhaust strokes, noise and vibrations generated in these strokes have very definite correlation with rotational angles. A rotational cycle signal is the same as a rotational cycle component of a motor for rotating the compressor mechanism portion. Therefore, a signal of a rotational noise component can be generated based on a current waveform flowing through the motor.

On the other hand, electromagnetic noise is caused by an electromagnetic attraction force in a motor unit of the compressor. Therefore, an electromagnetic noise component can be generated by a harmonic component corresponding to an even-numbered multiple of a power supply frequency and extracted from a driving voltage waveform of the motor.

Therefore, the electromagnetic noise component is extracted from the driving voltage waveform of the compressor, the rotational noise component is extracted from the driving current waveform, a modulated noise component is generated based on these components, and an additional tone signal for active noise (cancel) control can be generated based on a signal obtained by synthesizing these components.

An electro-acoustic converter arranged in a machine room can be driven by the additional tone signal generated in this manner, thereby actively controlling a noise component externally leaking from an opening of the machine room.

When the additional tone signal is generated, an input signal of the additional signal generator has a phase opposite to that of a noise waveform signal of the compressor at a noise canceling point. Thus, transfer characteristics of a path of the signal are measured, and the measured characteristics are divided by transfer characteristics between an input terminal of the electro-acoustic converter and the noise canceling point, thereby determining transfer characteristics of the additional tone signal generator. Such characteristics can be realized by a known FIR (Finite Impulse Resonance) digital filter.

According to the active noise control technique of the present invention, noise components which are apt to externally leak from the opening of the machine room can be effectively suppressed in response to only noise components generated by the rotary machine unlike a conventional technique using a microphone or a vibration pickup.

An embodiment of the present invention based on the above-mentioned principle will be described below with reference to the accompanying drawings.

Figure 2:
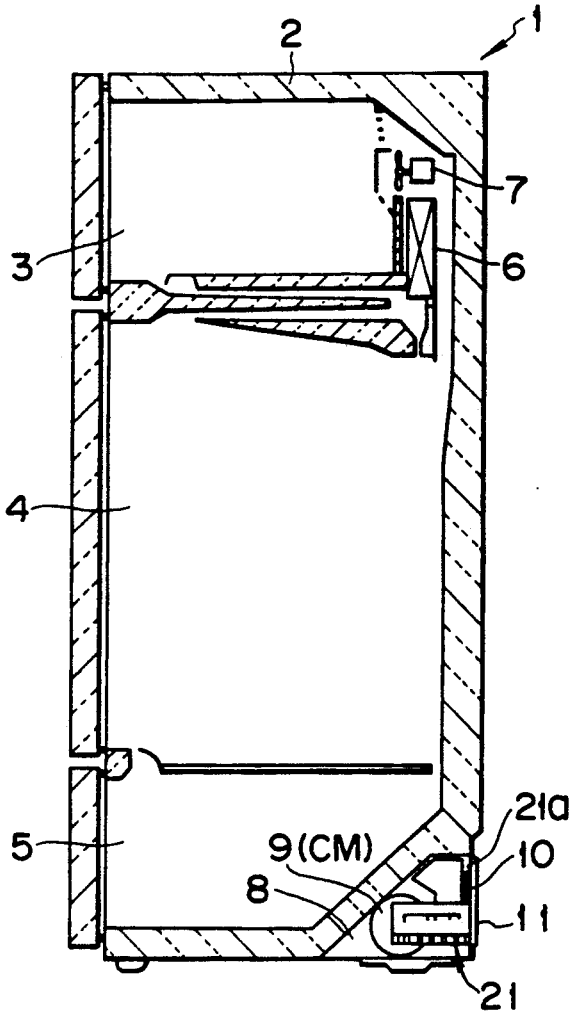
FIG. 2 is a sectional view of an electrical refrigerator which incorporates the active noise control apparatus shown in FIG. 1.

FIG. 2 illustrates a schematic arrangement of an electrical refrigerator 1 which is assembled with an active noise control apparatus for a domestic appliance according to a embodiment of the present invention. In the electrical refrigerator 1, the interior of a housing 2 is divided into three compartments in the vertical direction, i.e., a freezing compartment 3, a refrigeration compartment 4, and a vegetable compartment 5 from the above like in a conventional one. Openable/closable doors are respectively mounted on the front portions of these compartments. A cooling device 6 and a fan 7 are arranged behind the freezing compartment 3.

Figure 3:
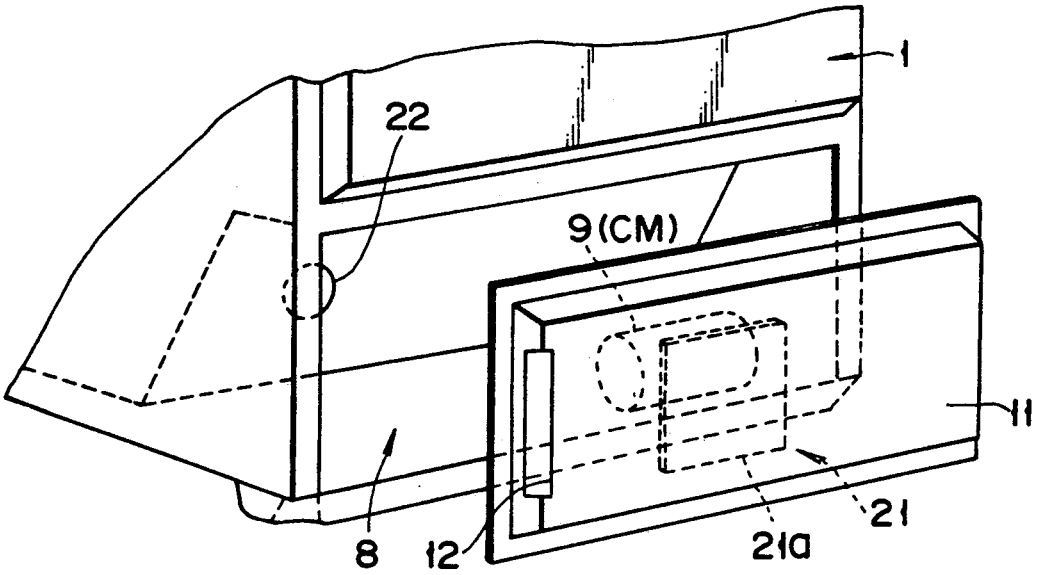
FIG. 3 is an exploded perspective view for explaining a structure of a machine room provided to a second electrical refrigerator.

A machine room 8 is arranged in a lower portion of the housing 2 on the side of the rear surface. The machine room 8 stores a compressor 9 comprising a compressor motor CM, and a piping system 10 connected to the compressor 9. The machine room 8 is closed by a cover 11, as shown in FIG. 3. Therefore, the compressor 9 and the piping system 10 are housed in a closed space. An opening 12 for delivering heat generated upon operation of the compressor 9 is formed in the cover 11.

A control apparatus main body 21*a* and an electro-acoustic converter, e.g., a loudspeaker 22 as constituting elements of an active noise control apparatus 21 are arranged at positions near the opening 12 in the machine room 8.

The active noise control apparatus 21 actively controls noise components such as beat noise, which is apt to externally leak from the opening 12, on the basis of the above-mentioned principle. More specifically, noise components generated by the compressor 9 include beat components caused by beat noise between electro-magnetic noise generated by a motor unit and rotational noise generated by a mechanical unit due to a frequency shift of 1 to 2 Hz between a driving frequency of the motor and a rotational frequency of a compressor mechanism portion. The presence of the beat components is offensive to the ears of persons. As compared to a single tone, the beat components sound uncomfortable even if they have a lower power level than that of the single tone. The active noise control apparatus 21 cancels the electromagnetic noise to reduce the beat noise.

The active noise control apparatus 21 has an arrangement as shown in FIG. 1. More specifically, electromagnetic noise is generated by the electromagnetic attraction force in the compressor motor CM. For this reason, the electromagnetic noise component has close correlation with a harmonic component corresponding to an even-numbered multiple of a power supply frequency and generated on the basis of a voltage waveform (frequency may be used) of an AC power supply for driving the compressor. In this embodiment, a voltage waveform detector 23 is connected to an AC power supply line for driving the compressor motor CM of the compressor 9, and a (x2) frequency multiplier 24 and a harmonic generator 25 generate a signal correlative to the electromagnetic noise component to be canceled on the basis of the signal detected by the detector 23. More specifically, since the electromagnetic noise component corresponds to an even-numbered multiple of a power supply frequency, the power supply frequency is multiplied with 2, and thereafter, a necessary electro-magnetic noise component is generated by the harmonic generator 25. Such processing can be realized by using, e.g., a PLL (Phase Locked Loop) circuit. The electromagnetic noise component signal generated in this manner is supplied to an additional tone signal generator 26 for canceling noise. The additional tone signal generator 26 comprises a known FIR digital filter. The output from the additional tone signal generator 26 drives the loudspeaker 22. Note that the abovementioned circuits 23 to 26 are arranged on a printed circuit board as the control apparatus main body 21*a*.

The FIR digital filter has characteristics ($G=-G_{SO}/G_{AO}$) obtained by dividing transfer characteristics $G_{SO}$ from the output terminal of a signal P generated by the harmonic generator 25 to a noise cancel objective point O of the opening 12 by the transfer characteristics from an input point Q of the loudspeaker 2 to the noise cancel objective point O.

That is, the phases and amplitudes of frequency components of the input signal are adjusted by the FIR digital filter, and an acoustic signal which can cancel the electromagnetic noise component at the noise cancel objective point O is produced from the loudspeaker 22. Note that $G_{SO}$ and $G_{AO}$ can be easily measured by using a 2-channel FFT analyzer.

Figure 8:
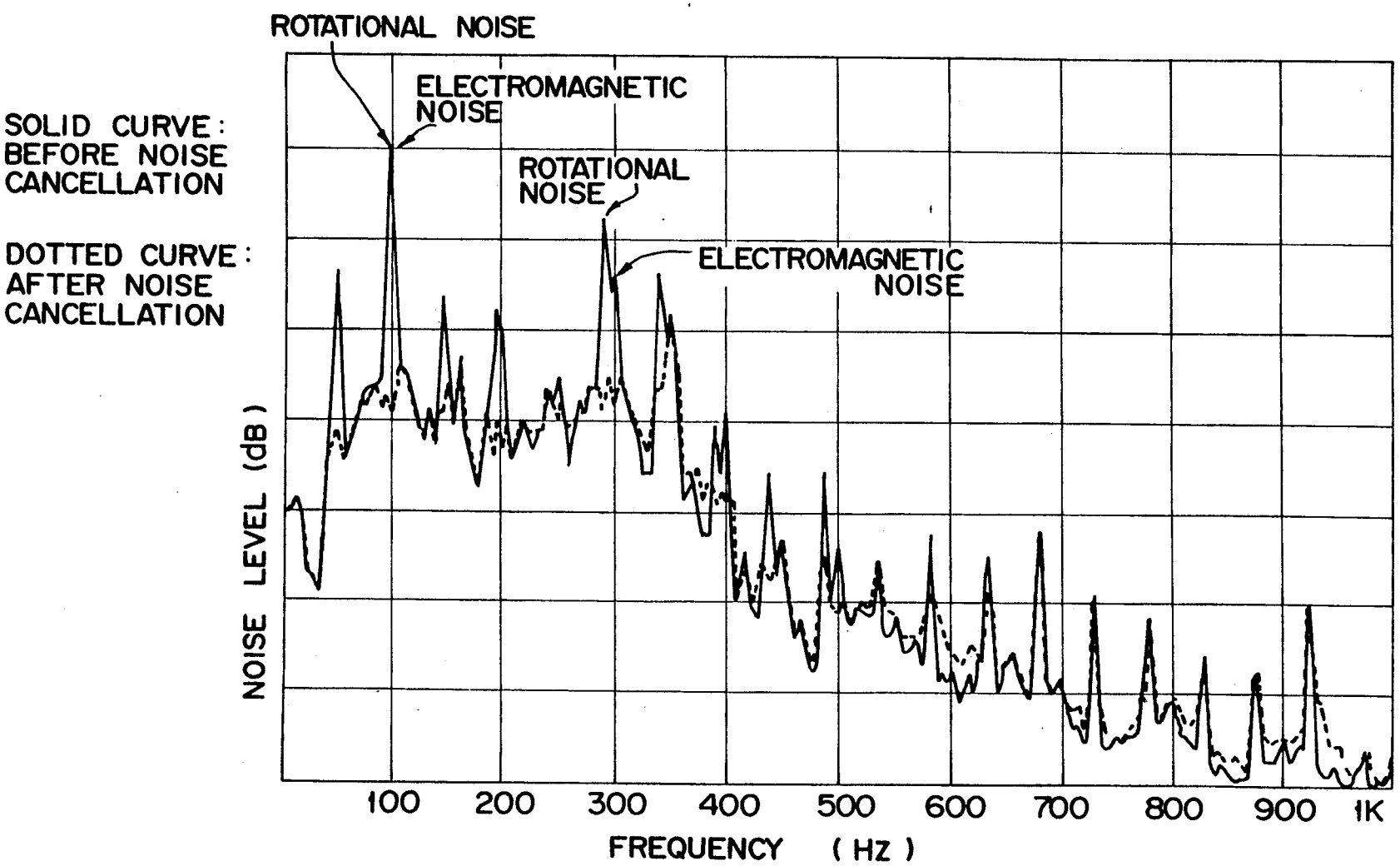
FIG. 8 is a graph showing a noise spectral distribution generated by a compressor in contrast to a noise reduction effect according to the present invention.
Figure 9:
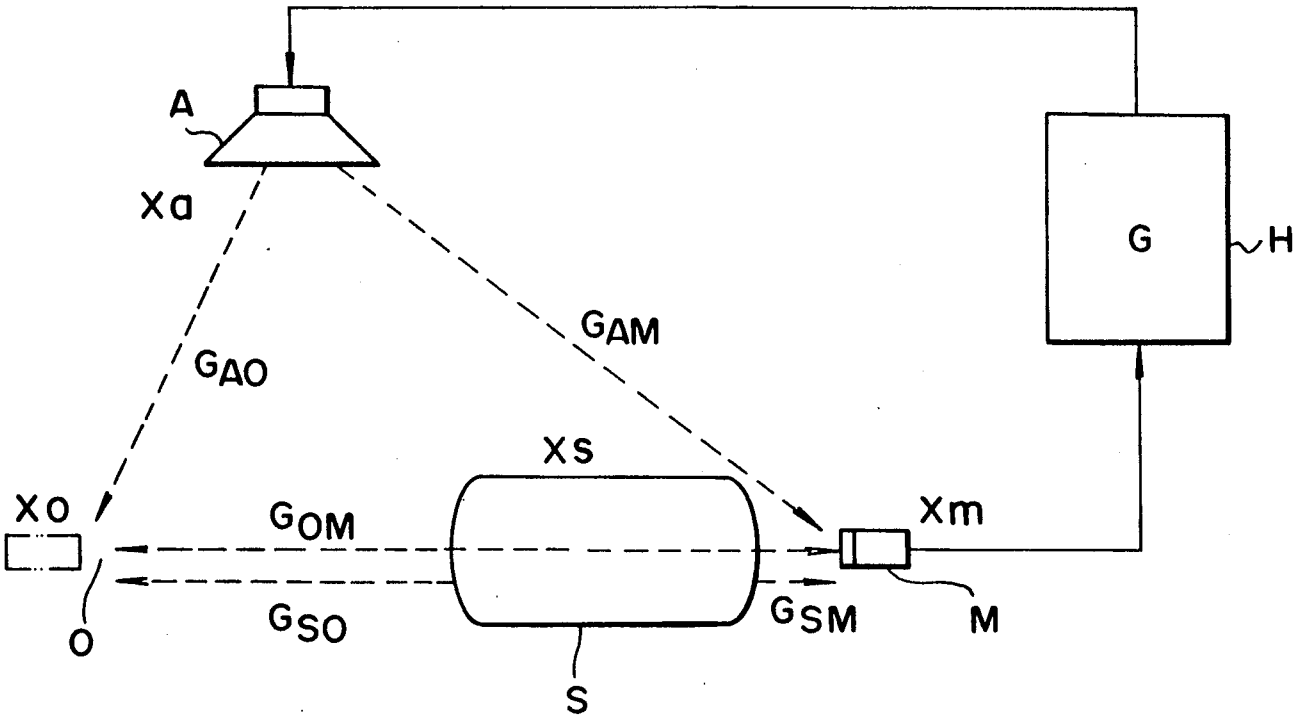
PRIOR ART FIG. 9
FIG. 9 is a schematic diagram showing an arrangement of a conventional active noise control apparatus.

With this arrangement, noise of a target frequency component, in this embodiment, an electromagnetic noise component can be effectively reduced by about 5 dB (ISO-A characteristics) without using a detection element such as a microphone or a vibration pickup which tends to be easily operated by a disturbance, as indicated by a solid curve in FIG. 8. Thus, external leakage of irritating beat noise can be prevented.

Figure 4:
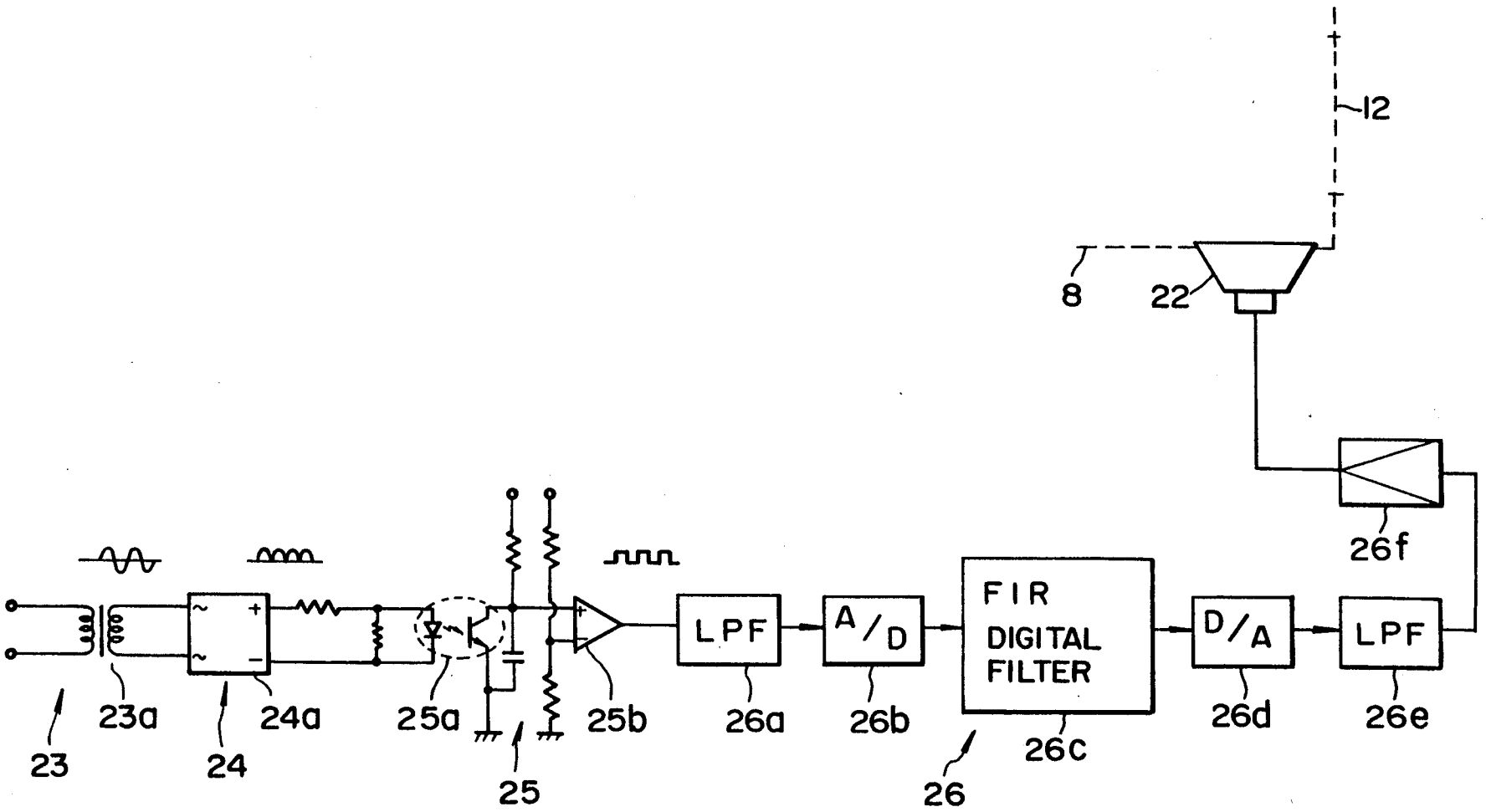
FIG. 4 is a detailed circuit diagram of the active noise control apparatus shown in FIG. 1.

FIG. 4 shows a detailed circuit arrangement of the active noise control apparatus shown in FIG. 1. The voltage waveform detector 23 may comprise a transformer 23*a* as a simplest example. The frequency multiplier 24 may comprise a full-wave rectifier 24*a*. The harmonic generator 25 may comprise an insulating circuit consisting of a photocoupler 25*a* and a pulsation circuit consisting of a comparator 25*b*. Pulses output from the pulsation circuit include a fundamental wave of 100 Hz twice the power supply frequency (e.g., 50 Hz) output from the frequency multiplier 24, and its second-, third-, fourth-, fifth-, sixth-order, . . . harmonic components of 200 Hz, 300 Hz, 400 Hz, 500 Hz, 600 Hz, . . . The additional tone signal generator 26 includes a low-pass filter 26*a* for allowing components below a sampling frequency (e.g., 2 kHz) used in, e.g., the next A/D converter 26*b*, the A/D converter 26*b* for A/D-converting components passing through the low-pass filter, an FIR digital filter 26*c* for executing predetermined coefficient processing for giving the optimal transfer function to the harmonic components of 100 Hz, 200 Hz, 300 Hz, 400 Hz, 500 Hz, 600 Hz, . . . on the basis of the digital signal from the A/D converter 26*b*, a D/A converter 26*d* for D/A-converting an output from the FIR digital filter 26*c*, a low-pass filter 26*e* for allowing only a desired signal component, serving as a noise control object, of the output components of the D/A converter 26*d*, and an amplifier 26*f* for amplifying the output from the low-pass filter 26*e* and supplying the amplified signal to the loudspeaker 22 as a driving signal.

In the above arrangement, the FIR digital filter 26*c* executes coefficient processing for giving a pre-determined transfer function for adjusting phases and amplitudes of components so that sound waves of respective frequency components have phases opposite to those included in noise components, and the same amplitudes as those of the noise components at the noise canceling point. The FIR digital filter preferably learns by itself to acquire coefficients for a necessary transfer function, and can utilize a technique described in a reference "MOTOROLA SEMICONDUCTOR TECHNICAL DATA DSP56200, Advance Information Cascade-Adaptive Finite-Impulse-Response (CAFIR) Digital Filter Chip, MOTOROLA INC., 1988".

Figure 5:
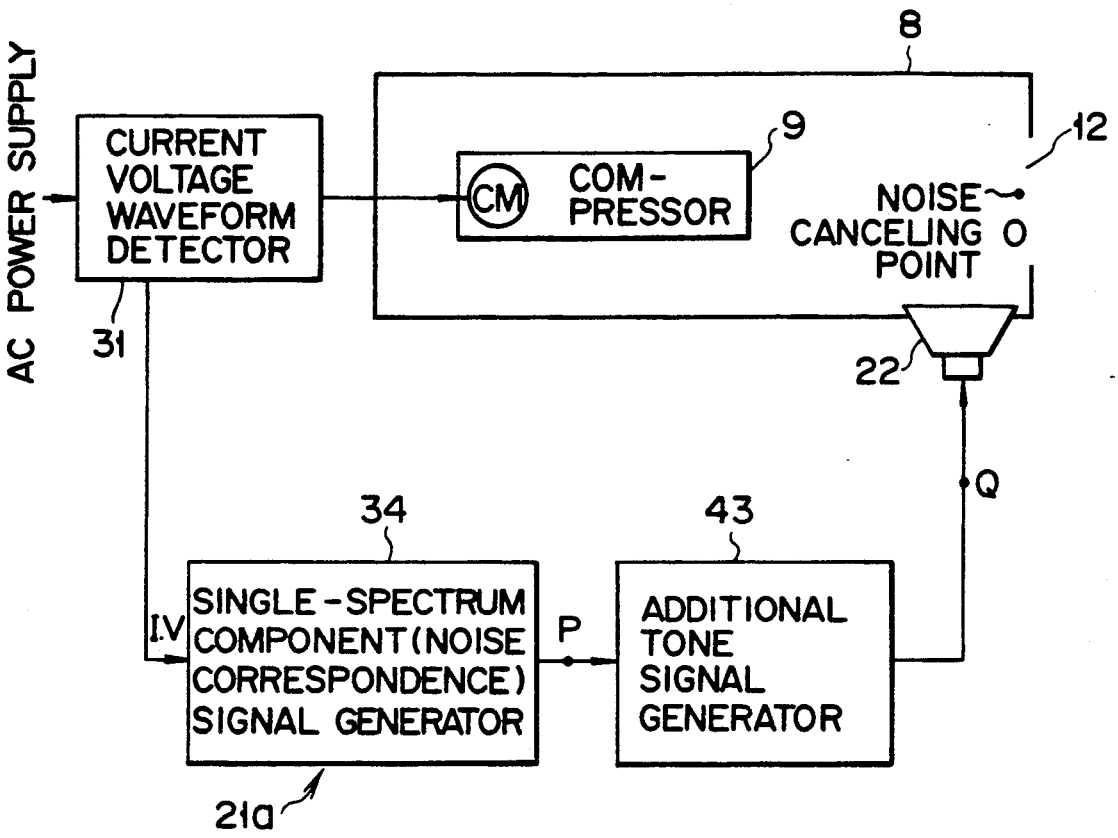
FIG. 5 is a block diagram of an active noise control apparatus according to another embodiment of the present invention.

FIG. 5 shows an active noise control apparatus 211 according to another embodiment of the present invention. The active noise control apparatus 211 shown in FIG. 5 is also applied to a case for preventing noise components from leaking from an opening 12 of a machine room 8 in an electrical refrigerator. In the first embodiment, only an electromagnetic noise component of noise components generated by the compressor 9 is canceled to actively control uncomfortable noise. The active noise control apparatus according to this embodiment can actively control noise components corresponding to frequency components of, e.g., 500 to 600 Hz which are apt to leak from the opening 12.

Figure 6:
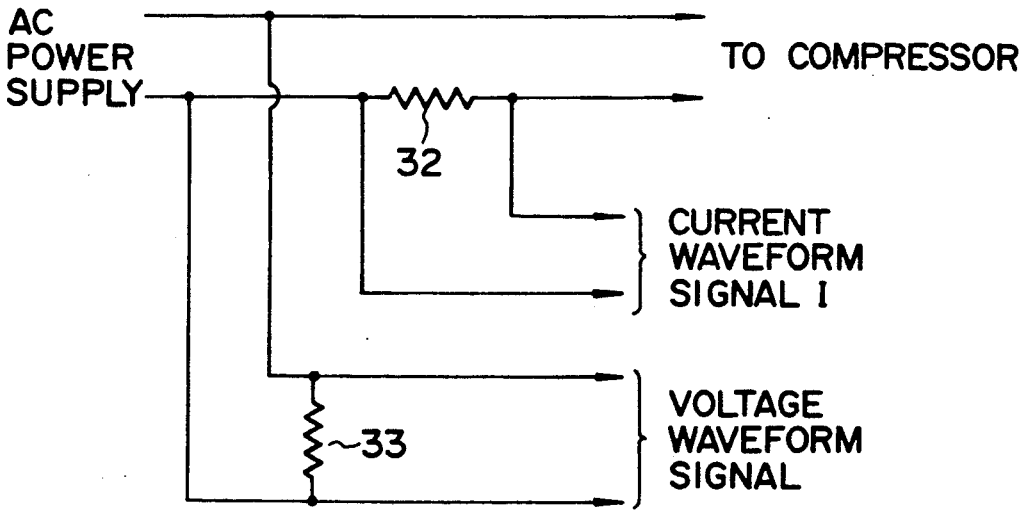
FIG. 6 is a diagram of a current·voltage waveform detector in the active noise control apparatus shown in FIG. 5.

The active noise control apparatus according to this embodiment has the following arrangement. That is, a current-voltage waveform detector 31 is inserted in an AC power supply line to the compressor 9. More specifically, in the current-voltage waveform detector 31, a resistor 32 is serially inserted in the AC power supply line, as shown in FIG. 6, so that a current wave signal I is obtained across two terminals of the resistor 32. A resistor 33 is connected between the AC power supply line, so that a voltage waveform signal V is obtained across two terminals of the resistor 33. The current and voltage waveform signals I and V obtained in this manner are input to a single-spectrum component signal generator 34.

Figure 7:
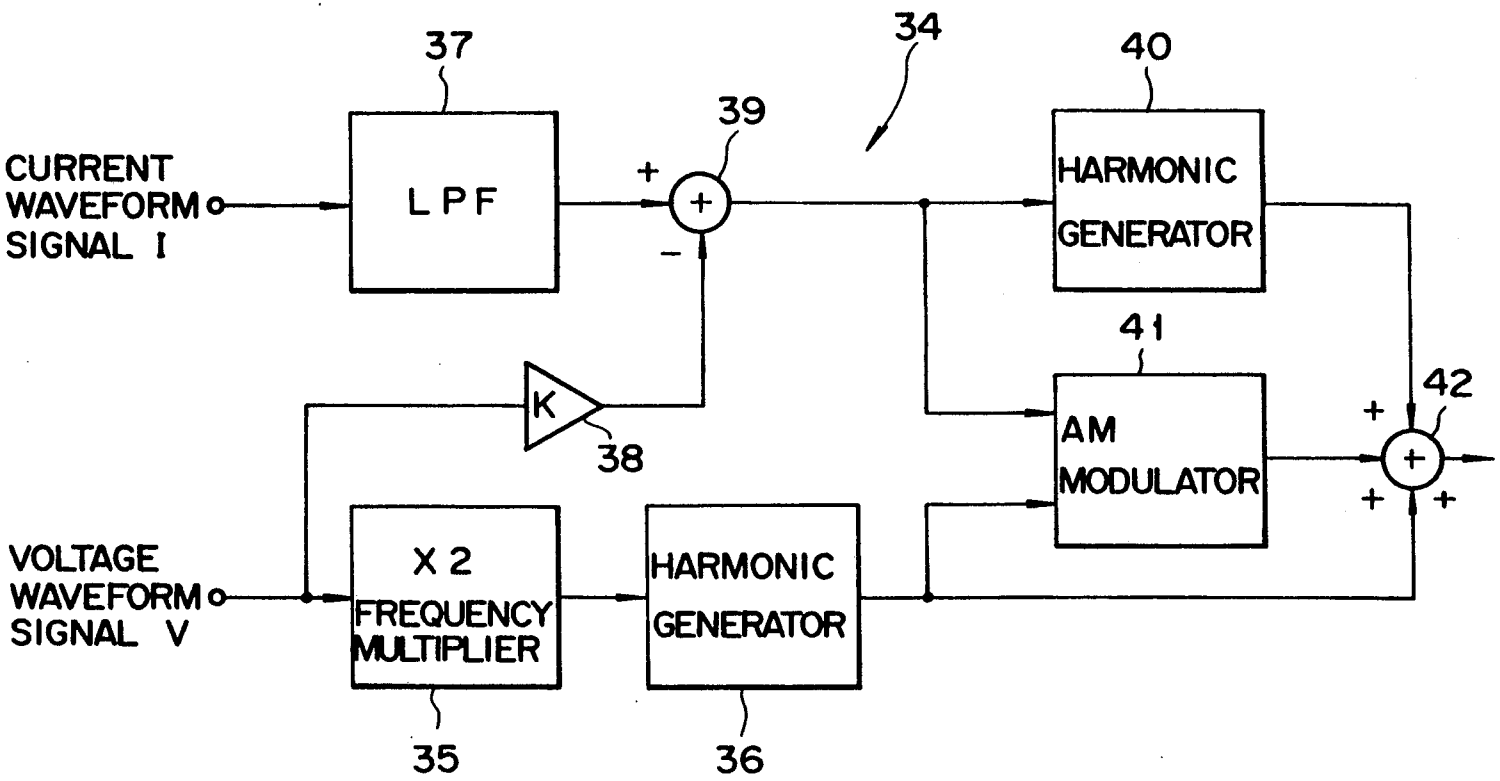
FIG. 7 is a block diagram showing a single-spectrum component signal generator in the active noise control apparatus shown in FIG. 5.

More specifically, the single-spectrum component signal generator 34 is arranged as shown in FIG. 7. That is, since a frequency of an electromagnetic noise component of noise components generated by the compressor 9 corresponds to an even-numbered multiple of a power supply frequency, the voltage waveform signal V is frequency-multiplied by a (x2) frequency multiplier 35 comprising, e.g., a full-wave rectifier, and the frequency-multiplied signal is distorted by a harmonic generator 36, thereby obtaining a signal of a necessary electromagnetic noise component frequency. On the other hand, since a frequency of a rotational noise major component corresponds to an integer multiple of a rotational speed component superimposed on the current waveform signal I, harmonic components are cut by filtering the current waveform signal I by a low-pass filter 37, and the obtained signal and a signal obtained by passing the voltage waveform signal V through a phase/amplitude adjuster 38 are supplied to an adder 39. A difference between the two signals is calculated by the adder 39 to extract a rotational cycle component signal excluding a power supply frequency component. The output from the adder 39 is distorted by a harmonic generator 40, thus obtaining a spectrum component of rotational noise. In order to obtain a noise component associated with beat noise generated by modulating electromagnetic noise with the rotational speed component, the output signal from a harmonic generator 36 is modulated with the output signal from the adder 39 by an amplitude modulator 41. The output signals from the harmonic generators 36 and 40 and the output signal from amplitude modulator 41 are synthesized by an adder 42, and the synthesized signal is supplied to an additional tone signal generator 43 as a noise component signal of the compressor 9.

The additional tone signal generator 43 comprises the same FIR digital filter as in the first embodiment. A loudspeaker 22 is driven by a signal generated by the additional tone generator 43. The FIR digital filter has characteristics ($G=-G_{SO}/A_{AO}$) obtained by dividing transfer characteristics $G_{SO}$ from the output terminal of a signal P generated by the harmonic generator 25 to a noise cancel objective point O of the opening 12 by the transfer characteristics from an input point Q of the loudspeaker 22 to the noise cancel objective point O like in the above embodiment.

In this manner, the active noise control apparatus according to this embodiment can reliably and actively control noise using elements which do not respond to external noise.

In the above embodiment, noise is prevented from leaking from an opening formed in a machine room of an electrical refrigerator. The present invention is not limited to this use. In most of rotary machines, a noise component signal can be generated using voltage and current waveforms. Therefore, the present invention can be directly applied to domestic electrical appliance other than the electrical refrigerator.

As described above, according to the present invention, there can be provided an active noise control apparatus for a domestic appliance, which can reliably and actively cancel a target noise component without being influenced by, e.g., noise components from a device other than a noise source arranged in a mechanism unit in a domestic appliance or external vibration.

Additional embodiments of the present invention will be apparent to those skilled in the art from consideration of the specification and practice of the present invention disclosed herein. It is intended that the specification and examples be considered as exemplary only, with the true scope of the present invention being indicated by the following claims.

What is claimed is:

1. An apparatus for actively controlling noise generated by an electromagnetic machine, said noise being apt to externally leak from an opening of a machine room storing said electromagnetic machine driven by an AC power supply, said apparatus comprising:

electro-acoustic conversion means for applying a predetermined sound wave to the opening of said machine room;

detection means for detecting a frequency of an AC voltage waveform to be applied to said electromagnetic machine driven by said AC power supply;

noise correspondence signal generating means for generating, according to a detection signal from said detection means, an output signal correlative with an electromagnetic noise component included in noise generated by said electromagnetic machine; and additional tone signal generating means for generating, according to said output signal from said noise correlative signal generating means, an additional tone signal for causing said electro-acoustic conversion means to apply a sound wave essentially having both a phase opposite to and the same amplitude as of the electromagnetic noise component propagating toward the opening of said machine room.

2. An apparatus according to claim 1, wherein said noise correlative component signal generating means comprises:

a frequency multiplier for doubling the detection signal from said detection means; and a harmonic generator for receiving an output signal from said frequency multiplier, and generating a fundamental wave of the output signal and a plurality of orders of harmonic signals.

3. An apparatus according to claim 2, wherein said detection means includes a transformer, a primary side of said transformer being connected to said AC power supply.

4. An apparatus according to claim 3, wherein said frequency multiplier includes a full-wave rectifier connected to a secondary side of said transformer.

5. An apparatus according to claim 4, wherein said harmonic generator comprises a pulsation circuit for pulsating an output from said full-wave rectifier.

6. An apparatus according to claim 5, wherein said harmonic generator includes an insulating circuit for insulating an output from said full-wave rectifier in an AC manner and supplying the output to said pulsation circuit.

7. An apparatus according to claim 5, wherein said additional tone signal generating means comprises:

a low-pass filter for low-pass filtering an output from said pulsation circuit;

an A/D converter for A/D-converting an output from said low-pass filter;

an FIR digital filter for filtering an output from said A/D converter to output a signal having transfer characteristics corresponding to the predetermined sound wave to be applied to the opening of said machine room; and a D/A converter for D/A-converting an output signal from said FIR digital filter.

8. An apparatus according to claim 7, wherein said additional tone signal generating means further comprises:

another low-pass filter for low-pass filtering an output from said D/A converter; and an amplifier for amplifying an output from said another low-pass filter.

9. An apparatus for actively controlling noise generated by an electromagnetic machine, said noise being apt to externally leak from an opening of a machine room storing said electromagnetic machine driven by an AC power supply, said apparatus comprising:

electro-acoustic conversion means for applying a predetermined sound wave to the opening of said machine room;

detection means for detecting an AC voltage waveform and an AC current waveform to be applied to said electromagnetic machine driven by said AC power supply;

noise correspondence signal generating means for generating, according to a detection signal from said detection means, an output signal having a spectrum corresponding to a combination of both an electromagnetic noise component and a rotational noise component generated by said electromagnetic machine; and additional tone signal generating means for generating according to said output signal from said noise correspondence signal generating means, an additional tone signal for causing said electro-acoustic conversion means to apply a sound wave essentially having a phase opposite to and the same amplitude as those of the combination of both the electromagnetic noise component and the rotational noise component propagating toward the opening of said machine room.

10. An apparatus according to claim 9, wherein said noise correspondence signal generating means comprises:

electromagnetic noise correspondence signal generating means for generating, in accordance with a detection signal associated with the AC voltage waveform from said detection means, a signal having a spectrum corresponding to the electromagnetic noise component included in the combination of both the electromagnetic noise component and a rotational noise component;

rotational noise correspondence signal generating means for generating, in accordance with a detection signal associated with the AC voltage waveform from said detection means, a signal having a spectrum corresponding to a rotational noise component included in the combination of both the electromagnetic noise component and a rotational noise component; and synthesizing means for synthesizing an output signal from said electromagnetic noise correspondence signal generating means and an output signal form said rotational noise correspondence signal generating means.

11. An apparatus according to claim 10, wherein said electromagnetic noise correspondence signal generating means includes a frequency multiplier for doubling the detection signal associated with the AC voltage waveform from said detection means, and a harmonic generator for distorting an output signal from said frequency multiplier to generate a harmonic signal corresponding to the spectrum of the electromagnetic noise component.

12. An apparatus according to claim 11, wherein said rotational noise correspondence signal generating means includes a low-pass filter for low-pass filtering the detection signal associated with the AC current waveform from said detection means, an adder for calculating a difference between an output signal from said low-pass filter and the detection signal associated with the AC voltage waveform, and another harmonic generator for distorting an output signal from said adder to generate a harmonic signal corresponding to a spectrum component of the rotational noise component.

13. An apparatus according to claim 12, wherein said noise correspondence signal generating means further includes an AM modulator for amplitude-modulating an output signal from said harmonic generator with an output signal from said adder, generating a signal corresponding to a modulated noise component included in the noise, and supplying the generated signal to said synthesizing means.

* * * * *